US010855001B2

(12) United States Patent
Niestrat et al.

(10) Patent No.: US 10,855,001 B2
(45) Date of Patent: Dec. 1, 2020

(54) SPRUNG BUSBAR TAPPING CLIP

(71) Applicant: HORA eTec GmbH, Bünde (DE)

(72) Inventors: Dirk Niestrat, Löhne (DE); Ralf Holtmann, Bünde (DE)

(73) Assignee: HORA eTec GmbH, Bünde (DE)

( * ) Notice: Subject to any disclaimer, the term of this patent is extended or adjusted under 35 U.S.C. 154(b) by 3 days.

(21) Appl. No.: 16/070,515

(22) PCT Filed: Jan. 19, 2017

(86) PCT No.: PCT/EP2017/051123
§ 371 (c)(1),
(2) Date: Jul. 16, 2018

(87) PCT Pub. No.: WO2017/125517
PCT Pub. Date: Jul. 27, 2017

(65) Prior Publication Data

US 2019/0386405 A1 Dec. 19, 2019

(30) Foreign Application Priority Data

Jan. 21, 2016 (DE) ..... 20 2016 100 281 U

(51) Int. Cl.
*H01R 4/38* (2006.01)
*H01R 4/48* (2006.01)
(Continued)

(52) U.S. Cl.
CPC ..... *H01R 4/38* (2013.01); *H01R 4/30* (2013.01); *H01R 4/305* (2013.01); *H01R 4/42* (2013.01); *H01R 4/48* (2013.01); *H01R 4/4818* (2013.01)

(58) Field of Classification Search
CPC ..... H01R 9/2691; H01R 9/26; H01R 9/2608; H01R 9/2675; H01R 25/142;
(Continued)

(56) References Cited

U.S. PATENT DOCUMENTS 6,806,424 B2 * 10/2004 Gerving ..... H01R 4/34 174/135
7,094,071 B2 * 8/2006 Hackemack ..... H01R 4/16 439/76.1
(Continued)

FOREIGN PATENT DOCUMENTS

DE 19934550 2/2001
DE 69804275 10/2002
(Continued)

OTHER PUBLICATIONS

English Translation of Niestrat et al., DE 10 2012 203 554, Sep. 20, 2012 (Year: 2012).*
(Continued)

*Primary Examiner* — Edwin A. Leon
*Assistant Examiner* — Matthew T Dzierzynski
(74) *Attorney, Agent, or Firm* — Liu & Liu

(57) ABSTRACT

Disclosed is a busbar tapping clamp (10) comprising a clamping member (16) that can be attached to a busbar (12) like a G-clamp, and sprung means (34) for bringing a conductor (32), which extends to the busbar tapping clamp (10), into electroconductive contact with the clamping member (16).

14 Claims, 11 Drawing Sheets

(51) Int. Cl.
*H01R 4/30* (2006.01)
*H01R 4/42* (2006.01)

(58) Field of Classification Search
CPC .... H01R 4/4827; H01R 9/2491; H01R 11/09; H01R 13/08; H01R 13/506; H01R 13/6278; H01R 13/629; H01R 2201/00; H01R 27/02; H01R 33/74; H01R 33/94; H01R 4/4836; H01R 4/64; H01R 9/2408
See application file for complete search history.

(56) References Cited

U.S. PATENT DOCUMENTS 7,101,231 B2 * 9/2006 Prokup ..... H01R 4/4809 439/709
7,686,626 B2 * 3/2010 Wu ..... H01R 4/64 439/95
8,251,738 B2 * 8/2012 Heckert ..... H01R 4/4836 439/441
8,308,516 B2 * 11/2012 Gassaur ..... H01R 4/4872 439/817
9,190,790 B1 * 11/2015 Gongora ..... H01R 25/142
2013/0237072 A1 * 9/2013 Keswani ..... H01R 25/142 439/110

FOREIGN PATENT DOCUMENTS

DE 202008017145 3/2009
DE 102012203554 9/2012
WO 0189037 11/2001

OTHER PUBLICATIONS

International Search Report of Counterpart PCT International Application No. PCT/EP2017/051123.

* cited by examiner

SPRUNG BUSBAR TAPPING CLIP

BACKGROUND OF THE INVENTION

The invention relates to a busbar tapping clamp, as known from DE 20 2011 000 622 U1 and DE 10 2012 203 554 A, i.e., a connection device for contacting a power busbar, referred to below as "busbar" for short, typically a copper bar or a bar made of some other suitable electrically conductive material which in particular has a rectangular or square cross section. The busbar tapping clamp brings about electroconductive contacting of the particular busbar. By use of the busbar tapping clamp, tapping of the potential that is provided via the busbar, for example in a switch cabinet or the like, is possible, and the potential that is thus centrally supplied may be conducted via the busbar tapping clamp to other locations in the switch cabinet, switch box, etc., for example in order to provide the particular potential to electrical devices present there such as fuse holders, circuit breakers, motor protection switches, contactors, plug sockets, and the like.

SUMMARY OF THE INVENTION

An object of the invention proposed herein is to provide a further embodiment of a busbar tapping clamp which is basically known from DE 20 2011 000 622 U1 or DE 10 2012 203 554 A.

This object is achieved according to the invention by means of a busbar tapping clamp having the features of claim 1. To this end, for a busbar tapping clamp having a clamping member, situated in a housing, with a hook-shaped extension that is included by the clamping member, the following is provided: The busbar tapping clamp and its clamping member include means for electroconductively contacting a busbar. The busbar tapping clamp is fixable to the busbar by means of a clamping device, which includes the extension in its function as a stop. For connecting electrical conductors to the busbar tapping clamp, the latter includes means, for example at least one spring force clamp, for bringing a conductor, led to the busbar tapping clamp, into electroconductive contact with the clamping member, using clamping spring technology. The housing of the busbar tapping clamp, for example a housing part, has means for ensuring a defined relative position of at least three components of the busbar tapping clamp. These components are at least the housing of the busbar tapping clamp, the clamping member, and the means for electroconductively contacting a conductor, for example a spring force clamp or multiple spring force clamps. The fixing of the busbar tapping clamp to the particular busbar takes place, for example, by means of a clamping screw that is screwed into the clamping member. Alternatively, this fixing may be achieved by means of a clamping device based on spring force.

A significant advantage of the busbar tapping clamp according to the invention lies in its optimized design with regard to simple manufacture. This also becomes evident in a method for manufacturing a busbar tapping clamp of the type described here and in the following discussion. The following is provided in such a method: Spring force clamps or other actuating means in clamping spring technology which function as means for electroconductively contacting a conductor led to the busbar tapping clamp are placed in the inner housing part in recesses provided for this purpose. In addition, the clamping member is placed in the inner housing part. In the process, the clamping member retaining means engage with one another (the clamping member, with engagement of the clamping member retaining means with one another, is placed in the inner housing part). In principle, it is not important whether the clamping member is placed in the inner housing part initially, or not until a second step. After the clamping member and the actuating means/spring force clamps are placed in the inner housing part and are held by the inner housing part in a defined position relative to one another and to the housing part itself, the inner housing part together with the components mounted in/on same are inserted as a whole into the outer housing part, and for example snapped on at that location.

For the following description, in order to avoid necessary repetition, features and details that are described in conjunction with the stated method for manufacturing a busbar tapping clamp and any embodiments of course also apply in conjunction with and with regard to the busbar tapping clamp in question, and conversely, so that the busbar tapping clamp may also be refined by means of single or multiple method features which allow or facilitate carrying out the method, and the manufacturing method may likewise be refined corresponding to single or multiple device features necessary for carrying out the method.

The advantage of the invention also lies in the fact that the fixing of the busbar tapping clamp to the particular busbar has long-lasting electrical and mechanical load capability. As a result of the clamping member with its hook-shaped extension being a solid part, fixing of the busbar tapping clamp to the particular busbar may be achieved with the clamping screw, as is known from a screw clamp or the like. The fixing to the busbar thus has extraordinary mechanical load capability, and is also suited, for example, for environments in which the busbar tapping clamp is subjected to particular mechanical stresses such as vibrations, which frequently occur during operation of electrical devices. The design of the clamping member, with its hook-shaped extension, as a solid component results in a large-surface contact at least between that portion of the extension that functions as a stop for the clamping device, and the busbar. Such a large-surface mechanical contact also results in secure electrical contacting of the particular busbar, wherein the entire surface of the portion of the extension, functioning as a stop, in contact with the busbar, as well as the entire bottom side of the clamping screw are available as contact points, and thus, locations for electrical charge transfer. An option for connecting electrical conductors, using clamping spring technology, likewise has very high mechanical and electrical load capability. It is known that a connection in clamping spring technology makes mechanically durable and electrically secure contact with a hard wire, for example a copper wire or the like, by means of a spring force that acts in each case in a retaining profile of a spring mechanism. The mechanical and electrical connection is based on self-locking of the particular spring mechanism, and if necessary the wire is easily releasable by appropriately actuating the particular spring mechanism. A connection point designed using clamping spring technology is characterized by a connection that may be quickly and easily established, and also easily released. Such a connection point, in particular a connection point implemented in the form of a spring force clamp, avoids sources of error, which for conventional screw connections may sometimes result from heat generation or vibrations.

Advantageous embodiments of the invention are the subject matter of the subclaims. Back references that are used refer to the further development of the subject matter of the busbar tapping clamp by the features of the respective subclaim. They are not to be construed as a waiver of the attainment of independent subject matter protection for the features of the subclaims, also independently of a particular back reference. Furthermore, with regard to interpretation of the claims and of the description, in the event of a more precise specification of a feature in a subordinate claim, it is to be assumed that there is no such limitation in the respective preceding claims or in a more general embodiment of the busbar tapping clamp in question. Accordingly, any reference in the description to aspects of subordinate claims is also to be explicitly construed, even without being specifically mentioned, as a description of optional features. Lastly, it is noted that the method indicated herein may also be refined according to the dependent device claims, and conversely.

Since the subject matter of the subclaims, with regard to the prior art on the date of priority, may form separate, independent inventions, the applicant reserves the right to make these the subject matter of independent claims or declarations of division. Moreover, the subject matter of the subclaims may also include separate inventions that are independent from the subject matter of the preceding subclaims.

In one particular embodiment of the busbar tapping clamp, clamping member retaining means, on the one hand in or on the housing and on the other hand in or on the clamping member, function as means for ensuring the defined relative position, explained above, at least of the stated components of the busbar tapping clamp.

Recesses in the clamping member as well as tabs on the housing for engaging in these recesses, for example, are suitable as clamping member retaining means. The housing holds spring force clamps, for example (which for better readability but without prejudice to further universal applicability are mentioned instead of means for making electroconductive contact with a conductor that is led to the busbar tapping clamp, but which are still to be construed as such), in a defined position. The clamping member is also held in a defined position in relation to the housing by clamping member retaining means in the form of recesses and tabs. This ensures overall that the spring force clamps, the clamping member, and the housing are situated in a defined position relative to one another which allows functioning of the busbar tapping clamp.

In one particular embodiment of the busbar tapping clamp, spring force clamps which have one leg that is fixed in the housing or by means of the housing, and one movable leg, wherein a free end of each fixed leg engages in the recess in the clamping member, function as means for electroconductively contacting a conductor. The spring force clamps are thus also connected (at least mechanically) to the clamping member, and the clamping member retaining means, for example in the form of the recesses in the clamping member, also directly ensure a defined position of the clamping member relative to the spring force clamps. Due to the retention of the clamping member and the spring force clamps by the housing, the spring force clamps, the clamping member, and the housing are situated in a defined position relative to one another which allows functioning of the busbar tapping clamp.

In another particular embodiment of the busbar tapping clamp, the clamping member for electroconductively contacting a conductor includes lateral contact surfaces, and on each of these surfaces has at least one notch means, for example a notch means in the form of at least one rib extending transversely with respect to the longitudinal axis of an inserted conductor end. Such (a) notch means ensure(s) an increase in the retaining force that acts on a conductor connected to the busbar tapping clamp.

In another embodiment of the busbar tapping clamp, it is provided that the clamping member is a solid, one-piece component having at least one clamping screw thread hole, wherein the clamping device includes at least one clamping screw that is guided in the clamping screw thread hole, and wherein by means of the clamping screw the busbar tapping clamp is fixable to the busbar by clamping the busbar via the clamping screw, and to the portion of the extension that functions as a stop.

When the hook-shaped extension in the area of its hook-shaped contour has a one-piece design and is also joined to the clamping member in one piece, the clamping member may be manufactured in a single operation, and the extension is mechanically connected to the clamping member with sufficient strength to allow absorption of forces that occur during clamping of a busbar, in particular during clamping of a busbar between a clamping screw and the clamping member extension.

When the clamping device for fixing the busbar tapping clamp to the busbar is independent from one or more spring force clamps, conductors may be connected to or released from the busbar tapping clamp without releasing the fixing of the busbar tapping clamp to the busbar, and conversely. A release of the fixing of the busbar tapping clamp from the busbar may be appropriate, for example, when the position of the busbar tapping clamp on the busbar is to be changed, for example to attach additional busbar tapping clamps to the busbar. For such a situation it is also advantageous when electrical conductors, which may already be connected to the busbar tapping clamp, do not have to be released and later reconnected.

In yet another preferred embodiment of the busbar tapping clamp, it is provided that the housing is an at least two-part housing having an inner housing part and an outer housing part that accommodates the inner housing part, and that the clamping member retaining means on the housing side, for example the tabs that engage in the recesses in the clamping member, are part of the inner housing part. In such an embodiment of the busbar tapping clamp, the spring force clamps and the clamping member may be mounted on the inner housing part, wherein the inner housing part ensures the defined relative position between the inner housing part, the clamping member, and the spring force clamps, and the resulting combination may be inserted as a whole into the outer housing part, the manufacture of the busbar tapping clamp being concluded by the insertion into the outer housing part. The outer housing part fixes the spring force clamps and the clamping member, placed in the inner housing part, in their relative position that is provided for functioning of the busbar tapping clamp. The inner housing part and the outer housing part optionally are releasably connected to one another, for example by snapping on. Manufacture of the busbar tapping clamp without tools and with favorable options for automation is thus possible overall.

For further embodiments of the busbar tapping clamp, it is provided that a recess, determined by the geometry of the hook-shaped extension, between the portion of the extension that functions as a stop, and a bottom side of the other clamping member, in particular in the area of a clamping screw thread hole, allows a combination of the busbar tapping clamp with busbars having different thicknesses and widths. A maximum thickness of busbars to which a busbar tapping clamp of the type described here and discussed below is fixable is a thickness that corresponds to a clearance between the portion of the extension that functions as a stop and an oppositely situated bottom side of the other clamping member, in particular the area having the clamping screw thread hole. With busbars of lesser thickness, the busbar tapping clamp may be combined, for example, by screwing a clamping screw into the thread formed in the clamping screw thread hole until contact is made with a top side of the busbar. A minimum thickness of a busbar to which a busbar tapping clamp of the type described here and discussed below is fixable is thus a thickness that results from a clearance of the type described above, minus a free length of the thread of the clamping screw. Theoretically, the free thread of the clamping screw extends to the portion of the extension that functions as a stop, even without a busbar being inserted into the recess formed by the extension, so that even very thin busbars are reliably contactable. In practice, however, due to static considerations, busbars have a certain minimum thickness which allows fixing of one or more busbar tapping clamps, also without warping the busbar or the like. Based on this premise, the busbar tapping clamp may be reliably connected to busbars of any given thickness less than the maximum thickness described above.

The greatest possible protection of the current-conducting parts against contact is provided when the housing also includes the hook-shaped extension, except for the recess for combining with the busbar. In addition, the extension with the housing section formed at that location may thus be incorporated into the overall design of the busbar tapping clamp, resulting in an attractive exterior. The protection against contact may be even further improved when the busbar is equipped with covers, such as cover caps, which are combined with the power busbar adjacent to the busbar tapping clamp, for example by sliding over, snapping on, etc.

Effective protection against contact is likewise achieved when the busbar tapping clamp, with its housing in a state mounted on a busbar, covers a surface of the busbar. An operator who lets a screwdriver slip from a busbar tapping clamp, for example when connecting or releasing electrical conductors, cannot come into contact with the area of the surface of the busbar that is covered by the housing of the busbar tapping clamp, so that danger to the operator is reduced. In addition, when the busbars are equipped with appropriate cover caps, the current distribution may be made essentially safe to the touch.

When a clamping screw or the like that is intended for fixing the busbar tapping clamp to the busbar is set back from actuating elements, for example spring force clamps, provided in the area of the upper housing part, for fixing electrical conductors to the busbar tapping clamp, protection against contact is easily provided, as well as an option for the operator to identify those parts (clamping screw, actuating element, etc.) that are provided on the one hand for fixing the busbar tapping clamp to the busbar, or on the other hand for connecting electrical conductors to the busbar tapping clamp. Operator errors are thus largely eliminated, and the operator will intuitively make correct use of clamping screws, actuating elements, on the top side of the busbar tapping clamp.

One exemplary embodiment of the invention is explained in greater detail below with reference to the drawings. Mutually corresponding objects or elements are provided with the same reference numerals in all figures.

The, or each, exemplary embodiment is not to be construed as limiting to the invention. Rather, numerous alterations and modifications are possible within the scope of the present disclosure, in particular variants which are inferable by those skilled in the art with regard to achieving the object, for example by combining or modifying individual features or elements described in conjunction with the general or specific portion of the description and contained in the claims and/or drawings, and which by means of combinable features, result in a new subject matter or new method steps or method step sequences, also to the extent that they relate to manufacturing methods, for example.

DETAILED DESCRIPTION OF ILLUSTRATED EMBODIMENTS

Figure 1:
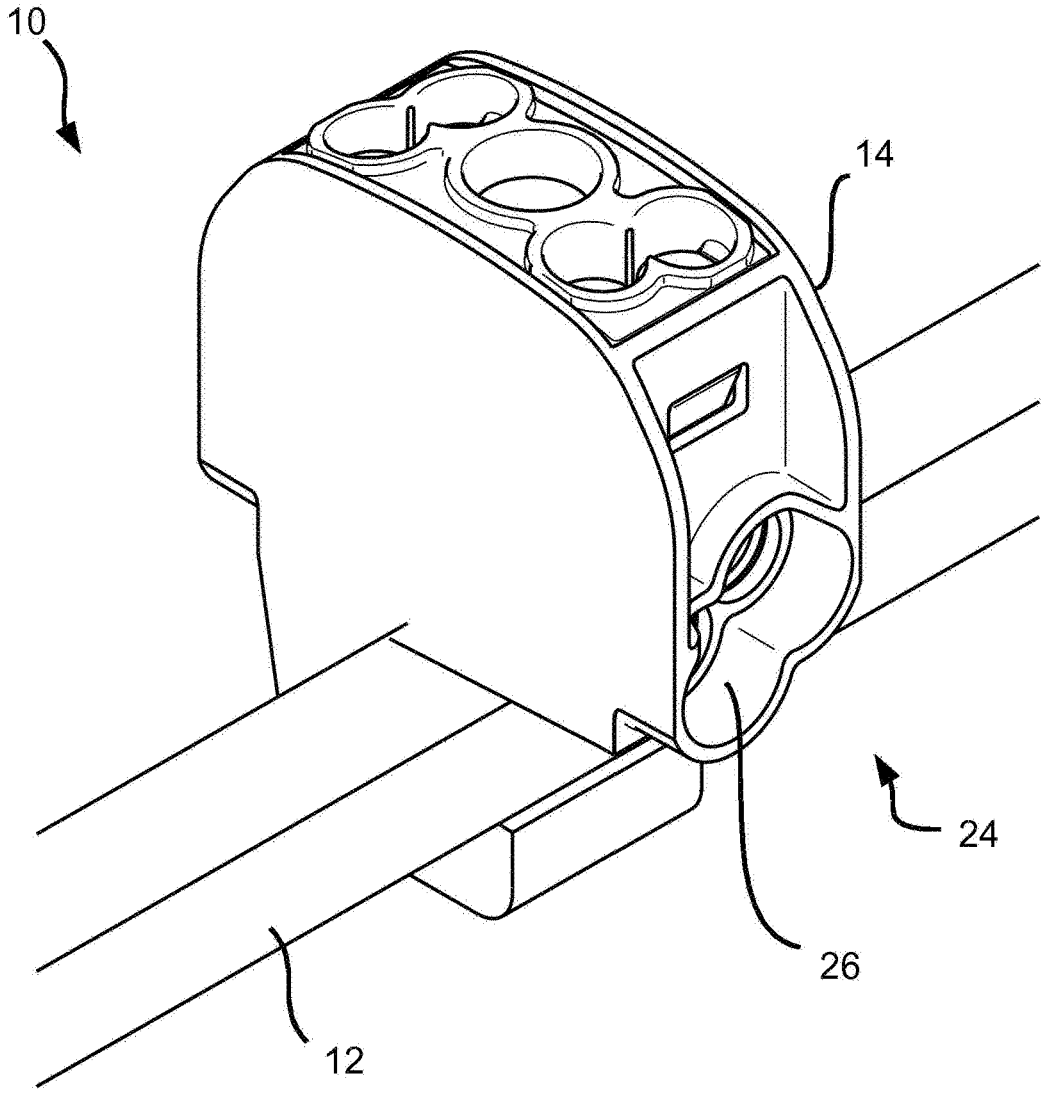
Fig. 1 (Prior Art)
FIG. 1 shows a side view of an embodiment of a busbar tapping clamp that is already known.

The illustration in FIG. 1 shows an isometric side view of an embodiment of a busbar tapping clamp 10 that is already known (DE 20 2011 000 622 U1, DE 10 2012 203 554 A). The busbar tapping clamp is mounted on a busbar 12.

The following description, at this point, is provided based on this previously known busbar tapping clamp 10; by this reference, DE 20 2011 000 622 U1 and DE 10 2012 203 554 A themselves, strictly as a precaution, are deemed incorporated in full into the present description.

Figure 2:
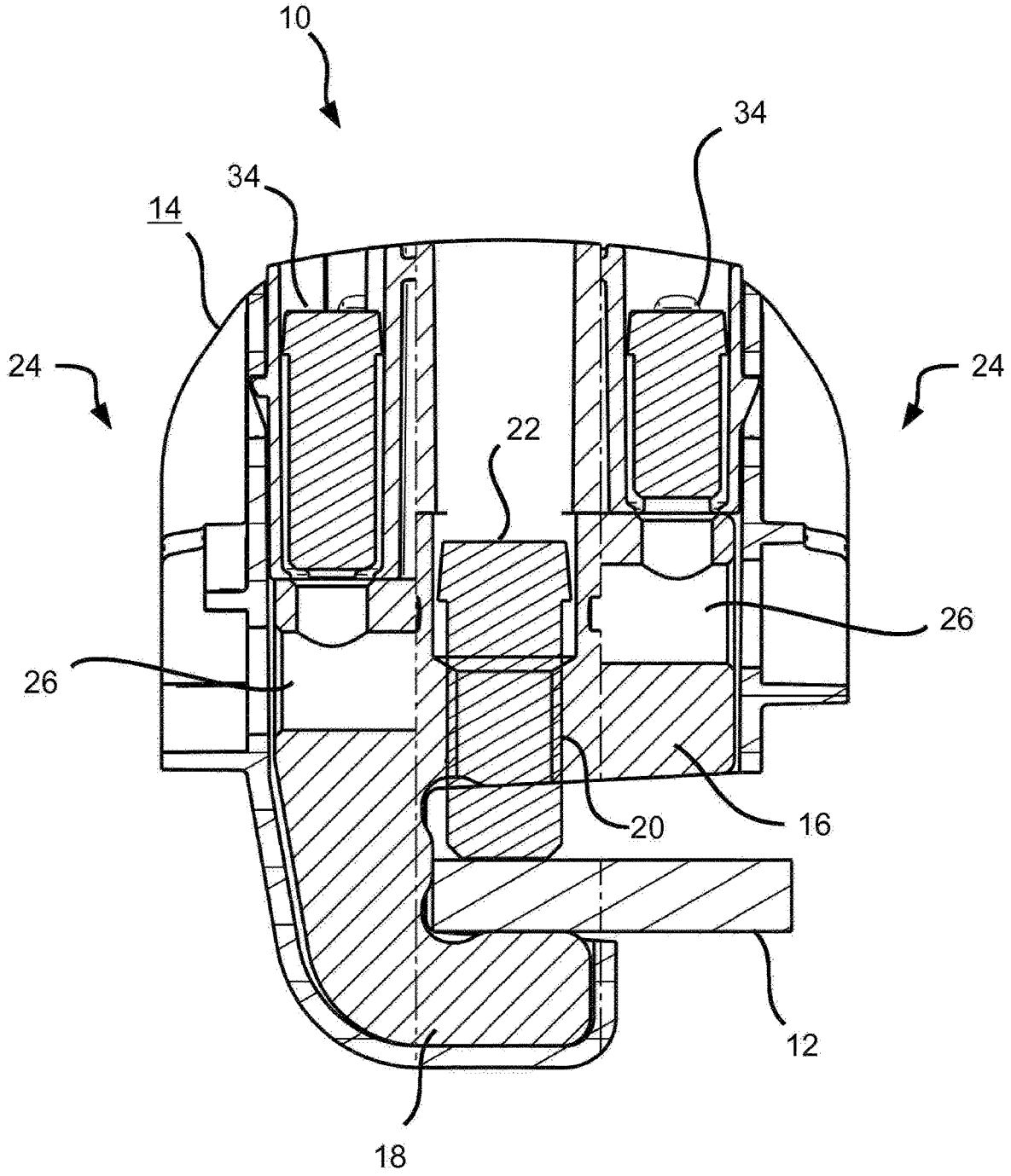
Fig. 2 (Prior Art)
FIG. 2 shows the busbar tapping clamp from FIG. 1 in a sectional view, in a state in which it is fixed to a busbar.

FIG. 2 shows a sectional illustration of the embodiment of the busbar tapping clamp 10 according to FIG. 1. Accordingly, the busbar tapping clamp 10 has a clamping member 16 in a housing 14, the clamping member being characterized by a hook-shaped extension 18. The busbar tapping clamp 10 is fixable to the busbar 12 by means of a clamping device that includes the extension 18 in its function as a stop. In the embodiment shown, this clamping device also includes at least one clamping screw 22 that is guided in a clamping screw thread hole 20 in the clamping member 16. The clamping member 16 is a solid part, for example a brass block, an aluminum block, or in general a block made of an electrically conductive metal.

In the known embodiment shown in FIG. 2, the busbar tapping clamp 10 has conductor insertion openings 26 on oppositely situated connection sides 24.

The hook-shaped extension 18 has a one-piece design and is joined to the clamping member 16 in one piece. The clamping member 16 together with its hook-shaped extension 18 thus forms a formed metal block. The busbar tapping clamp 10 is fixable to the busbar 12 via the clamping screw 22, by clamping the busbar 12 by means of the clamping screw 22 and the portion of the extension 18 that functions as a stop. The busbar 12 is thus situated in a recess 30 (FIG. 3) that is formed by the clamping member 16 and its hook-shaped extension 18, and at that location via the clamping screw 22 is clamped against the hook-shaped extension 18 of the clamping member 16, as in a screw clamp. Contact having exceptional mechanical strength and load capability is established between the busbar tapping clamp 10 and the busbar 12 due to this fixing of the busbar tapping clamp 10 to the busbar 12.

At the same time, however, this fixing also results in contact between the busbar tapping clamp 10 and the clamping member 16 which has exceptional electrical load capability and durability. For an electrically conductive clamping screw 22, electroconductive contact between the clamping member 16 and the busbar 12 likewise results via the mechanical contact of the clamping screw 22 with the busbar 12. The fact that the busbar 12 is clamped by means of the clamping screw 22 and the portion of the extension 18 that functions as a stop results in large-surface electroconductive contact with different surface sections of the busbar 12, namely, between a surface section of the busbar 12 and a surface section of the clamping member 16 in the area of the hook-shaped extension 18, and between a further surface section of the busbar 12 and a surface section of the clamping screw 22, which, due to being led in the clamping screw thread hole 20 formed in the clamping member 16, itself is electroconductively connected to the clamping member 16.

In the embodiment of the busbar tapping clamp 10 illustrated in FIG. 2, a clamping screw is shown as an actuating element 34 in each case for fixing one end of a conductor 32 (not shown in FIG. 2; see FIG. 4) that is inserted through a conductor insertion opening 26 into a borehole in the clamping member 16.

Figure 3:
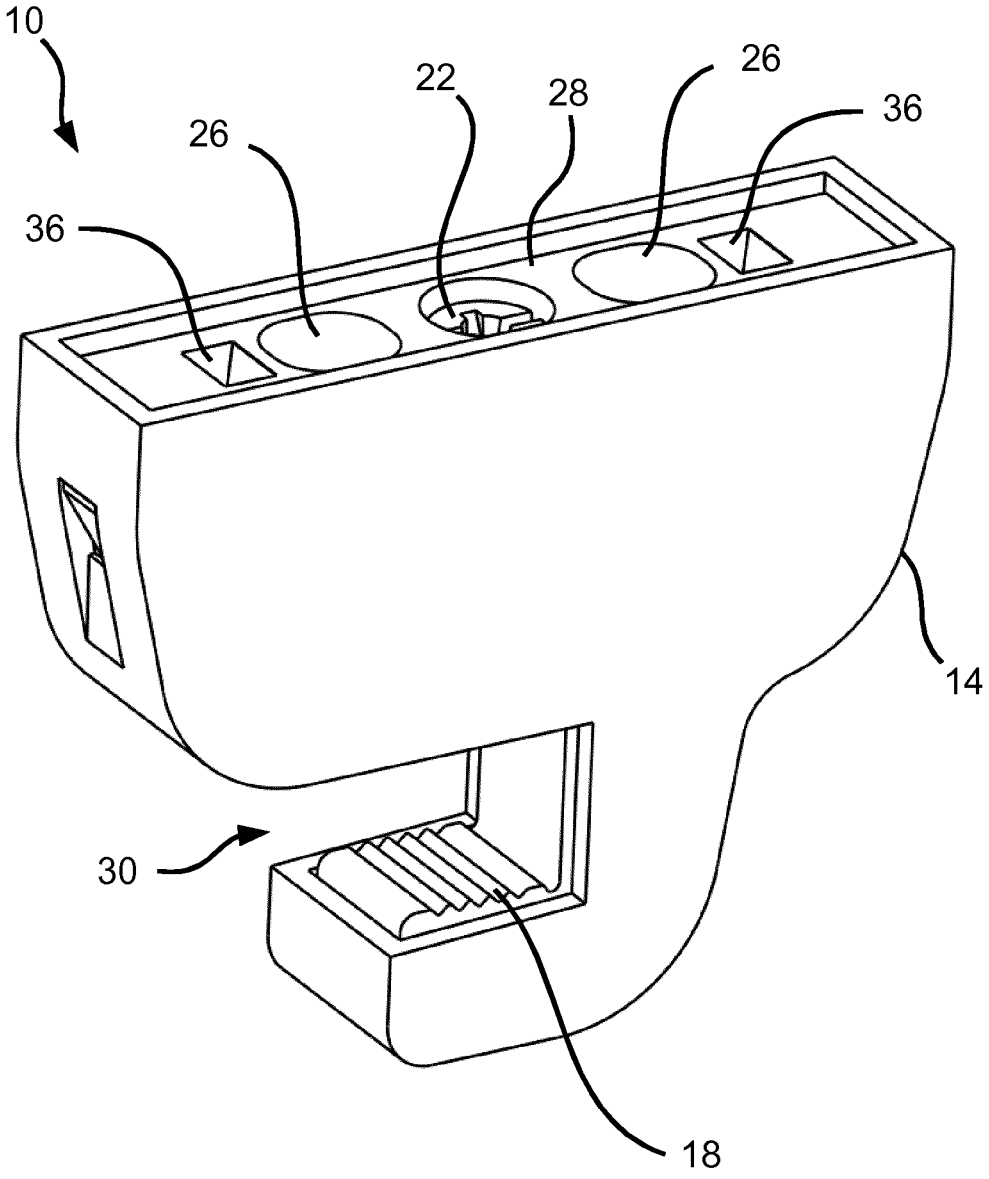
FIG. 3 shows an embodiment of a busbar tapping clamp of the type proposed herein.

The illustration in FIG. 3 shows an isometric view of an embodiment of the busbar tapping clamp 10 according to the invention. Here as well, the busbar tapping clamp has a clamping member 16 (FIG. 5) in a housing, with a hook-shaped extension 18 by means of which the busbar tapping clamp 10 is fixable to a busbar 12 (FIGS. 1, 2) for obtaining electroconductive contact with the busbar 12. The above discussion concerning the clamping member 16 and its extension 18 as well as the fixing of the busbar tapping clamp 10 to a busbar 12 thus applies to the busbar tapping clamp 10, presented for the first time at this point in the description. Combination of the busbar tapping clamp 10 with busbars 12 having different cross sections is possible due to the geometry of the hook-shaped extension 18 and a width of the recess 30 that is thus specified.

On a top side 28 facing away from the extension 18, the busbar tapping clamp 10 has one or more conductor insertion openings 26—in the example shown, two conductor insertion openings 26, namely, one conductor insertion opening 26 on each side of a center axis in the area of the clamping screw 22. A tool insertion opening 36 is associated with each conductor insertion opening 26. In the exemplary embodiment shown, each tool insertion opening 36 is situated adjoining the respective conductor insertion opening 26, based on the center axis of the busbar tapping clamp 10.

Figure 4:
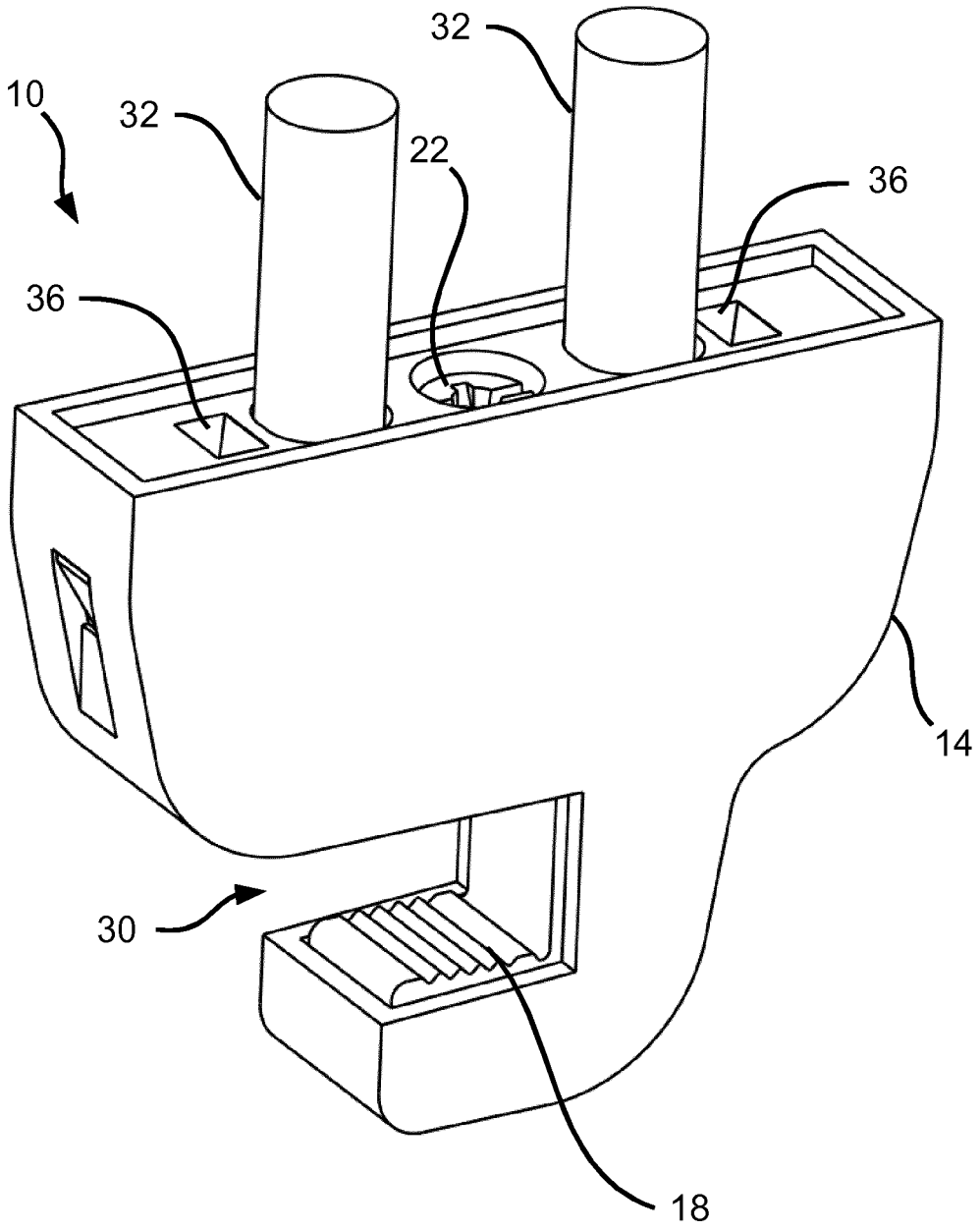
FIG. 4 shows the busbar tapping clamp according to FIG. 3 with attached conductors.

The illustration in FIG. 4 shows the busbar tapping clamp 10 according to FIG. 3 with conductors 32 connected to the busbar tapping clamp 10 and inserted into the conductor insertion openings 26.

Figure 5:
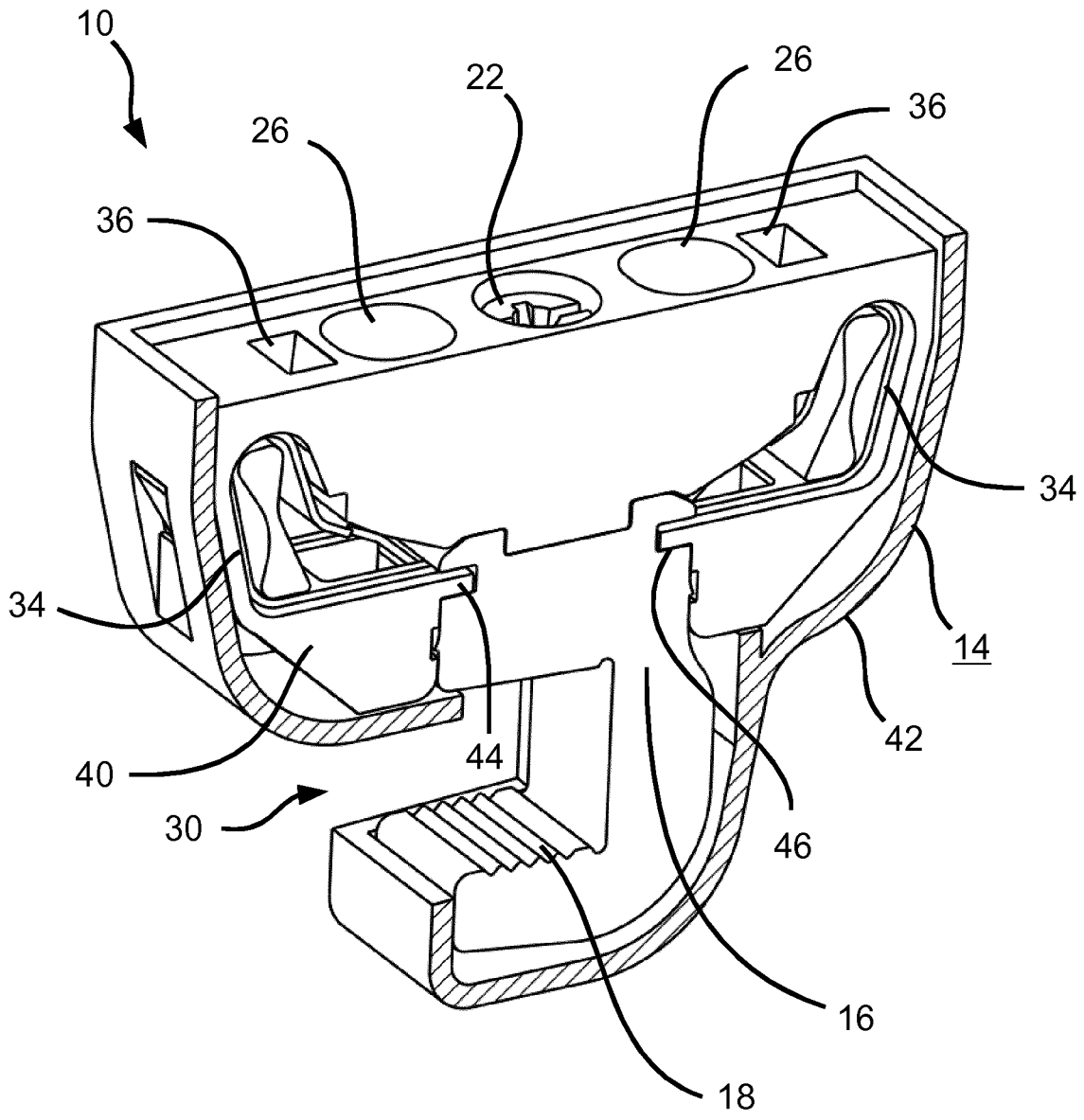
FIG. 5 and FIG. 6 show a longitudinal section of the busbar tapping clamp according to FIG. 3, FIG. 7*a* and FIG. 7*b* show a further longitudinal section of the busbar tapping clamp according to FIG. 3 with a different section plane.
Figure 6:
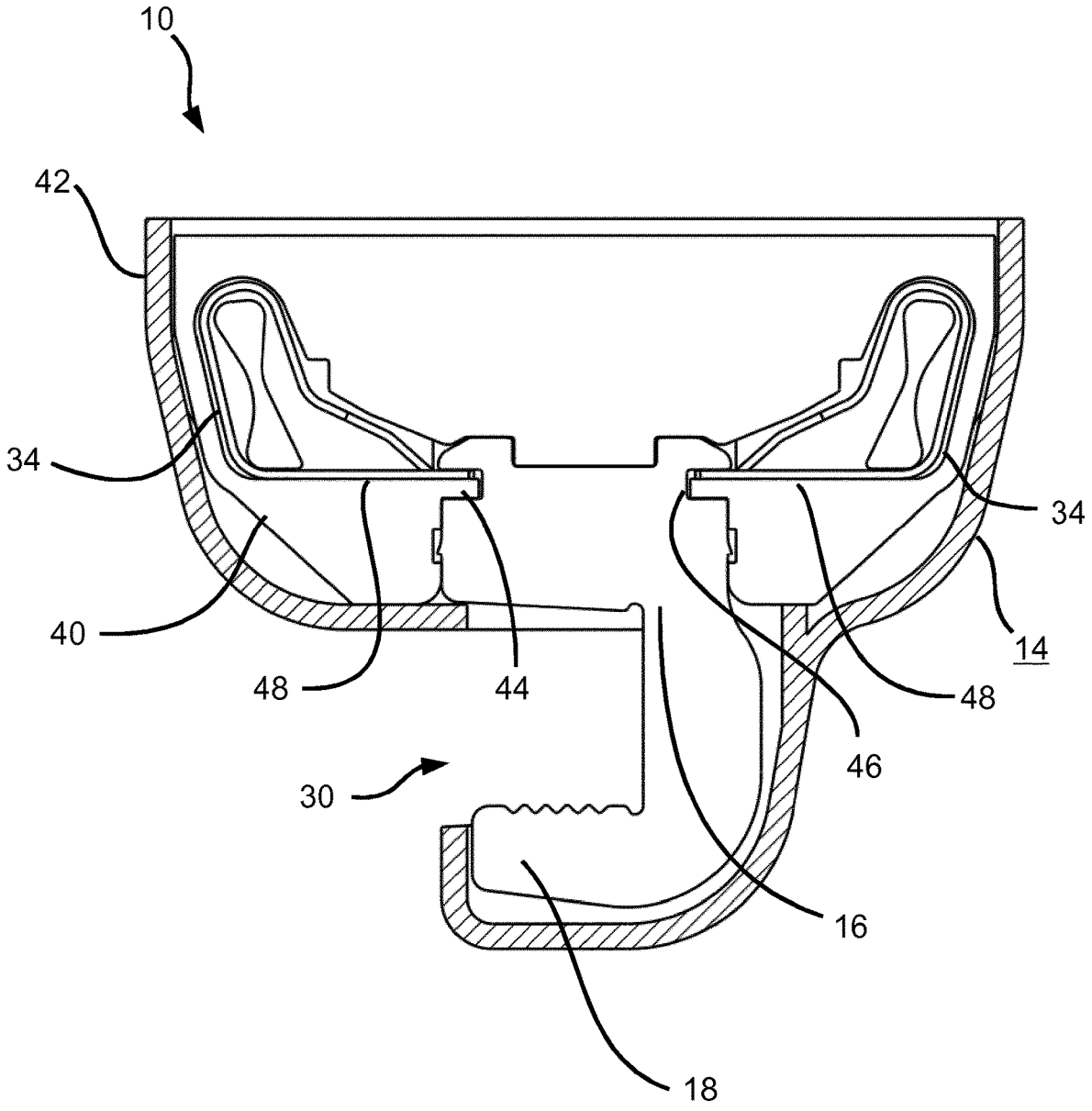

The illustrations in FIGS. 5 and 6 show the busbar tapping clamp 10 according to FIG. 3 in a partial sectional view. The illustration in FIG. 5 shows the busbar tapping clamp 10 in an isometric view as in FIG. 3. The illustration in FIG. 6 shows the busbar tapping clamp 10 in a side view. One of the two side walls of the housing 14, parallel to the vertical axis of the busbar tapping clamp 10 (the plane of the drawing in the illustration in FIG. 6), has been removed to obtain the sectional illustration. There is an unobstructed view of the clamping member 16 inside the housing 14, and of the actuating elements 34 of the busbar tapping clamp 10.

As actuating elements 34 for fixing one end of a conductor 32 (FIG. 4) that is connected to the busbar tapping clamp 10, the busbar tapping clamp 10 has actuating elements 34 in clamping spring technology. In the exemplary embodiment shown, a spring force clamp 34 in each case functions as an actuating element 34 in clamping spring technology. Spring force clamps 34 are basically known per se, and, as is known, are sometimes referred to as cage clamp terminals, cage clamps, or spring-loaded terminals. The spring force clamp 34 functions as an actuating element 34, since when a conductor 32 is connected to the busbar tapping clamp 10, its end actuates the spring force clamp 34, and for releasing a conductor 32 connected to the busbar tapping clamp 10, the spring force clamp 34 is actuated by means of a tool 38 (FIG. 8) that is inserted into a tool insertion opening 36 in order to release the conductor end.

It is also apparent in the sectional illustration in FIG. 5 that the housing 14 is a housing 14 composed of at least two parts. This housing includes an inner housing part 40 and an outer housing part 42 that accommodates the inner housing part 40, each preferably having a one-piece design. A releasable connection is suitable for combining the inner housing part 40 with the outer housing part 42. A detent hook that is formed on the inner housing part 40 and a corresponding detent hook receptacle formed in the outer housing part 42 for accommodating the detent hook in question are illustrated as an example of means, arbitrary in principle, for releasably fixing the inner housing part 40 in the outer housing part 42.

The inner housing part 40 supports the, or each, actuating element 34 of the busbar tapping clamp 10 as well as the clamping member 16. A clamp spring seat contour for accommodating and fixing a spring force clamp 34, at least in sections, in a form-fit manner is formed in the inner housing part 40 for accommodating a spring force clamp 34 in each case. In the embodiment shown, for retaining the clamping member 16 the inner housing part 40 has two tabs 44 that engage in corresponding recesses 46 in the clamping member 16 (only one tab 44 and only one recess 46 are depicted in the illustration in FIG. 5). The tabs 44 on the side of the inner housing part 40 and the recesses 46 in the clamping member 16 are examples of clamping member retaining means 44, 46. In the sense of a kinematic reversal, a tab 44 that functions as a clamping member retaining means 44 may also be a part of the clamping member 16 and intended for engagement in a recess 46 in the inner housing part 40 that functions as a clamping member retaining means 46. It is essential that, by means of the clamping member retaining means 44, 46, the clamping member 16 is releasably connected to the inner housing part 40, and that a defined relative position of the inner housing part 40 and the clamping member 16 is ensured by means of the clamping member retaining means 44, 46.

In the exemplary embodiment shown, a configuration which in principle is optional is illustrated in which one of the free ends of the clamping spring/spring force clamp 34 in each case also engages in the recess 46 in the clamping member 16. This free end of the spring force clamps 34 adjoins a leg of the spring force clamps 34, which is horizontal in the illustration (FIG. 6). This leg, which is horizontal in the illustration, rests on a supporting surface 48 that is formed in the inner housing part 40 and is likewise horizontal in the illustration. As a result of these free ends of the spring force clamps 34 likewise engaging in the recesses 46 in the clamping member 16, they also function as clamping member retaining means 44, 46, and due to the clamping member 16 conduct tensile and/or pressure forces to the inner housing part 40, in particular as a result of tensile and/or pressure forces due to the clamping member 16 being distributed over the supporting surface 48 of the inner housing part 40. This relieves load on the tabs 44 of the inner housing part, in particular when metallic spring force clamps 34 are used as spring force clamps 34.

Figure 7A:
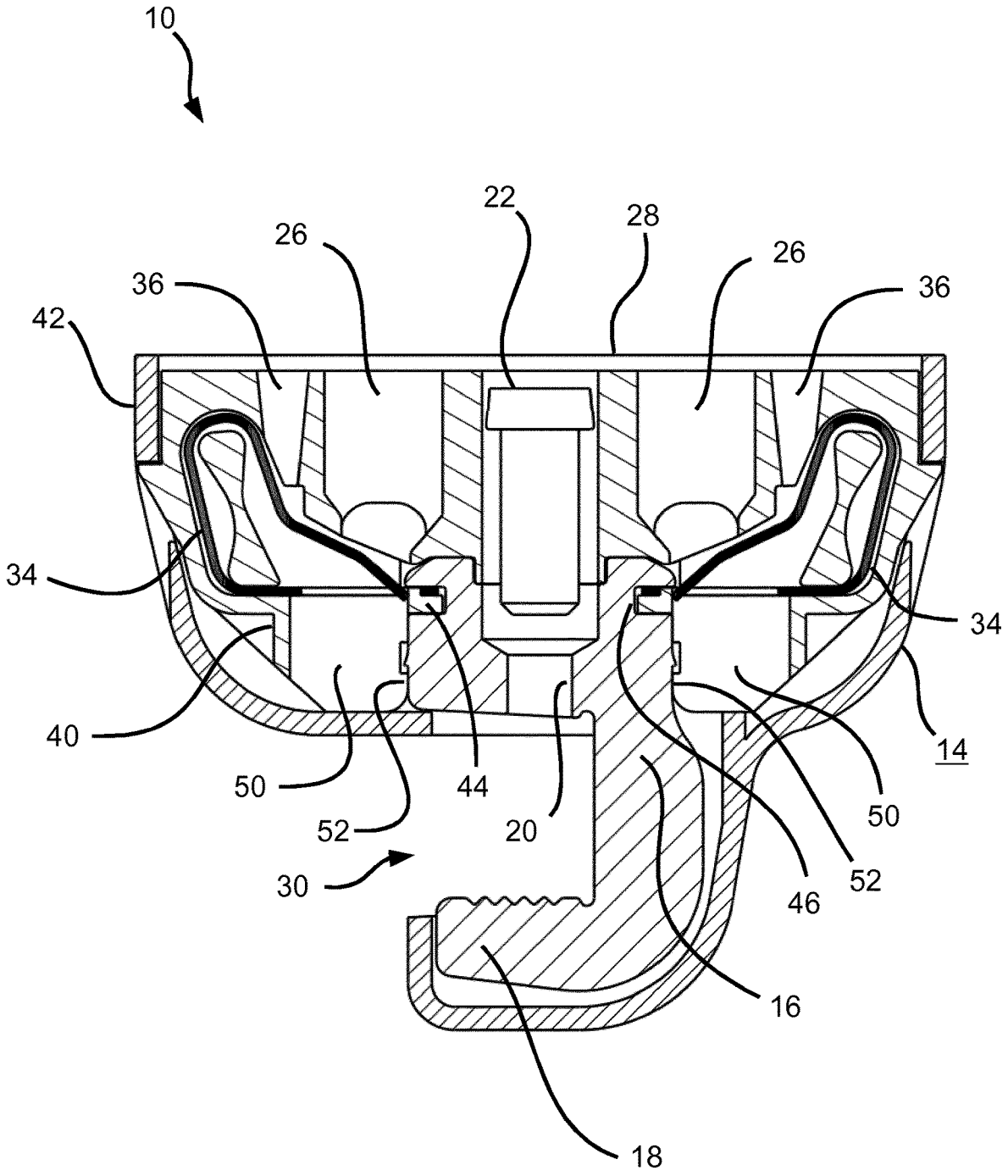
Figure 7B:
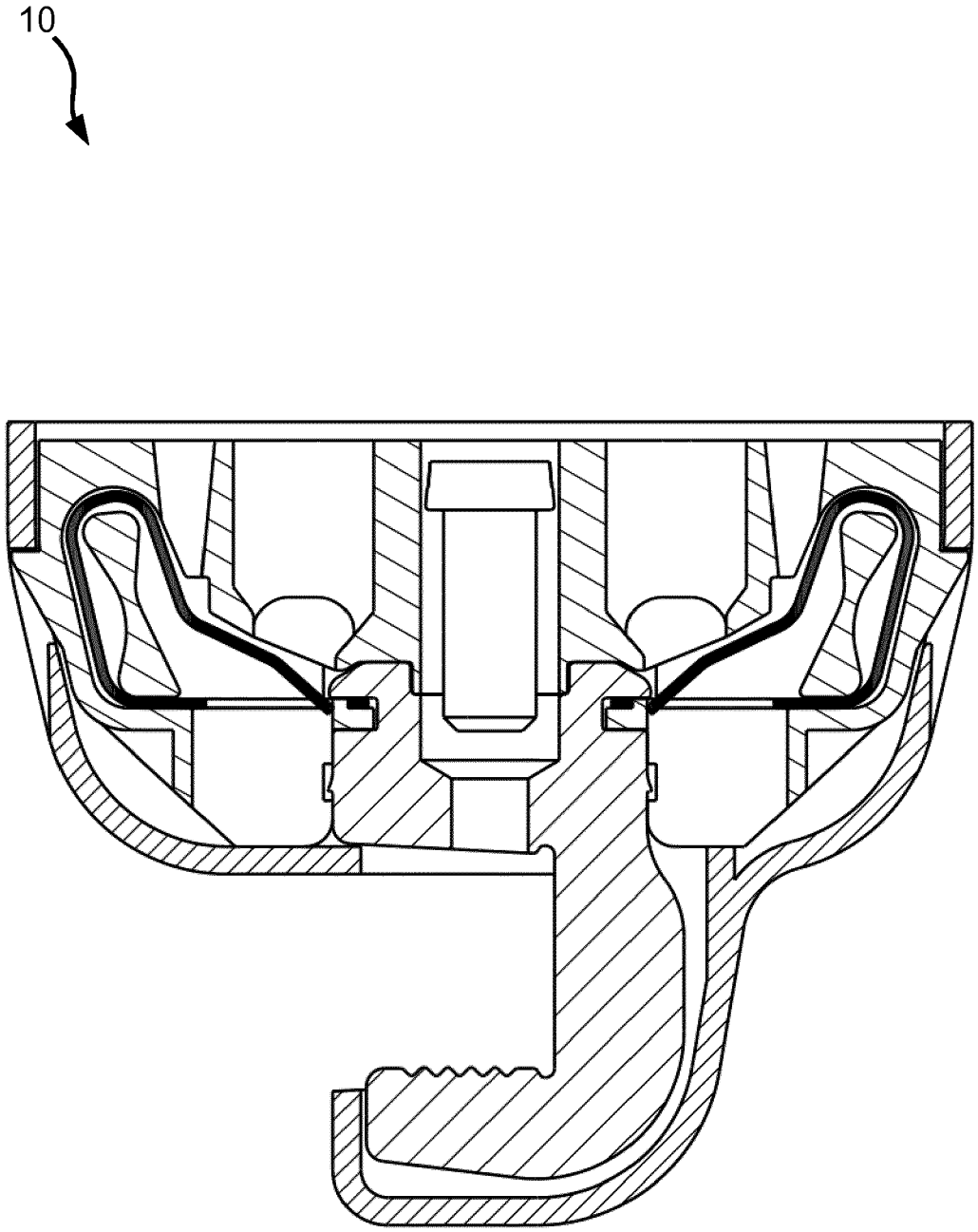
Figure 8:
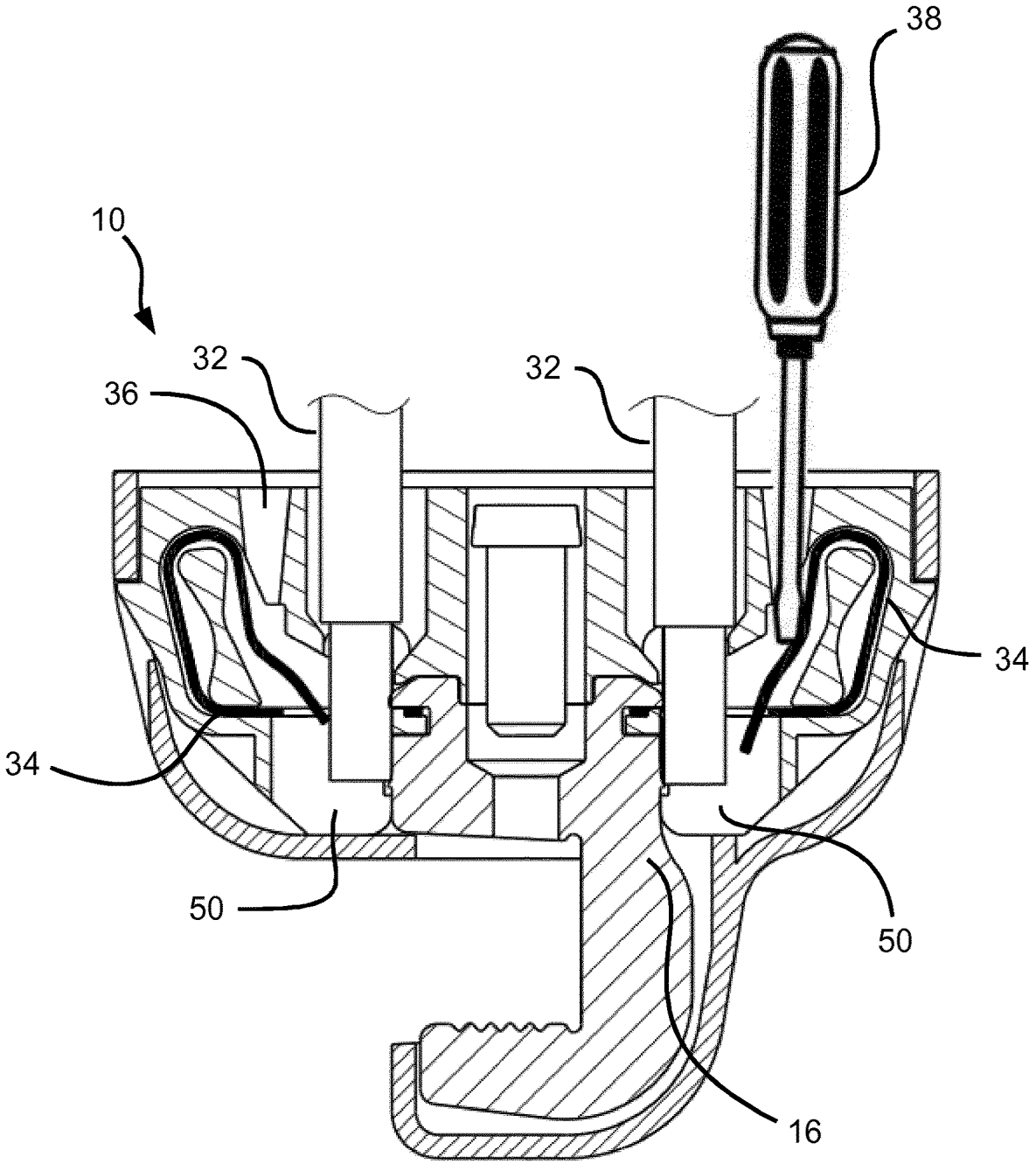
FIG. 8 shows the busbar tapping clamp according to FIG. 3 in the longitudinal section as in FIGS. 7*a*, 7*b*, with conductors that are inserted and held by spring force clamps, and a tool that is inserted for releasing a spring force clamp.

The illustration in FIGS. 7*a*, 7*b* shows a side view of another sectional illustration of the busbar tapping clamp 10 according to FIG. 3. The section plane, in comparison to the section plane in FIGS. 5 and 6, lies deeper and extends approximately centrally through the busbar tapping clamp 10. It is apparent in this illustration that the conductor insertion openings 26 are adjoined by a connection space 50 inside the busbar tapping clamp 10. The stripped end of a conductor 32 to be connected to the busbar tapping clamp 10 is in each case guided into this area (the illustration in FIG. 8 shows a connected conductor 32). The stripped end of the conductor 32 is guided through an eyelet in one of the two legs of the spring force clamp 34 in a manner basically known per se. This eyelet is part of the retaining profile of the spring force clamp 34, and is intended for guiding the conductor end through. In the embodiment shown, the eyelet is in the leg that is horizontal in the illustration. The conductor end is guided through this eyelet and thereby passes into the connection space 50. In the connection space 50, the conductor end is pressed against a side surface of the clamping member 16, which functions as a contact surface 52, by means of the other leg (the leg without the eyelet). This results in the electroconductive contact between the conductor end and the clamping member 16, and when a busbar tapping clamp 10 is connected to a busbar 12, results in the electroconductive contact between the conductor end and the busbar 12.

In the embodiment shown in the figures, the clamping member 16 optionally has on its contact surface 52 one or more notch means, for example in the form of the ribs shown (not denoted by a reference numeral), for improving the retention of a conductor end. The particular notch means, in particular the, or each, rib, with its surface or edge facing the conductor end notches into the surface of the conductor end. A similar notching effect is associated with the end of the movable leg of the spring force clamp 34. When at least one such rib is provided on the contact surfaces 52 of the clamping member 16, the conductor end is additionally retained by notching on both sides.

It is also pointed out that the clamping screw 22 is shown considerably above the clamping screw thread hole 20. When a clamping screw 22 is screwed into the clamping screw thread hole 20, the head of the clamping screw 22 is considerably below the top side 28 of the busbar tapping clamp 10 defined by the surface of the inner housing part 40. After the clamping screw 22 is tightened for fixing the busbar tapping clamp 10 to a busbar 12, the head of the clamping screw 22 is set back even farther from the top side 28. This acts as protection against contact, and with an appropriate cross section of the opening in the top side 28 of the busbar tapping clamp 10 provided for inserting the clamping screw 22, the busbar tapping clamp is safe to the touch, in particular since the spring force clamps 34 inside the housing 14 are likewise set back far from the top side 28.

By use of the clamping screw 22 for fixing the busbar tapping clamp 10 to the particular busbar 12 on the one hand, and spring force clamps 34 for fixing connected conductor ends on the other hand, the busbar tapping clamp 10 may, for example, be temporarily released from the busbar 12, for example to change a position of the busbar tapping clamp 10 on the busbar 12 without likewise having to release electrical conductors 32 that are possibly already connected to the busbar tapping clamp 10.

It is apparent from a comparison of the illustration in FIG. 1 and the busbar 12 shown there with the illustrations starting with FIG. 3, in particular the illustration in FIG. 3, that the busbar tapping clamp 10 with its housing 14, in a state mounted on a busbar 12, covers a portion of a surface of the busbar 12. The conductor insertion openings 26 begin considerably above the busbar 12 (or in a different orientation, considerably in front of the busbar 12), so that the risk of unintentional contact with the surface of the busbar 12 is already greatly reduced in this way. The width of the busbar tapping clamp 10 (measured transversely with respect to a busbar 12) and the resulting lateral coverage of the particular busbar 12 ensure additional safety.

The illustration in FIG. 8 shows the sectional view of the busbar tapping clamp 10 according to FIG. 7 with conductor ends inserted into the conductor insertion openings 26 and into the connection spaces 50. It is apparent that the conductor ends are pressed against one of the contact surfaces 52 of the clamping member 16 in order to obtain electroconductive contact with the clamping member 16 by means of the movable leg of the particular spring force clamp 34. It is also apparent that a conductor 32 that is connected to the busbar tapping clamp 10 may be released from the busbar tapping clamp 10 by means of a tool 38, for example the blade of a screwdriver (not shown true to scale). For this purpose, the movable leg of the particular spring force clamp 34 is deflected even further (further than through the conductor end itself) by means of the tool 38, so that the free end of the movable leg of the spring force clamp 34 is disengaged from the surface of the conductor end. The conductor end may then be pulled out of the connection space 50 and the conductor insertion opening 26.

Figure 9:
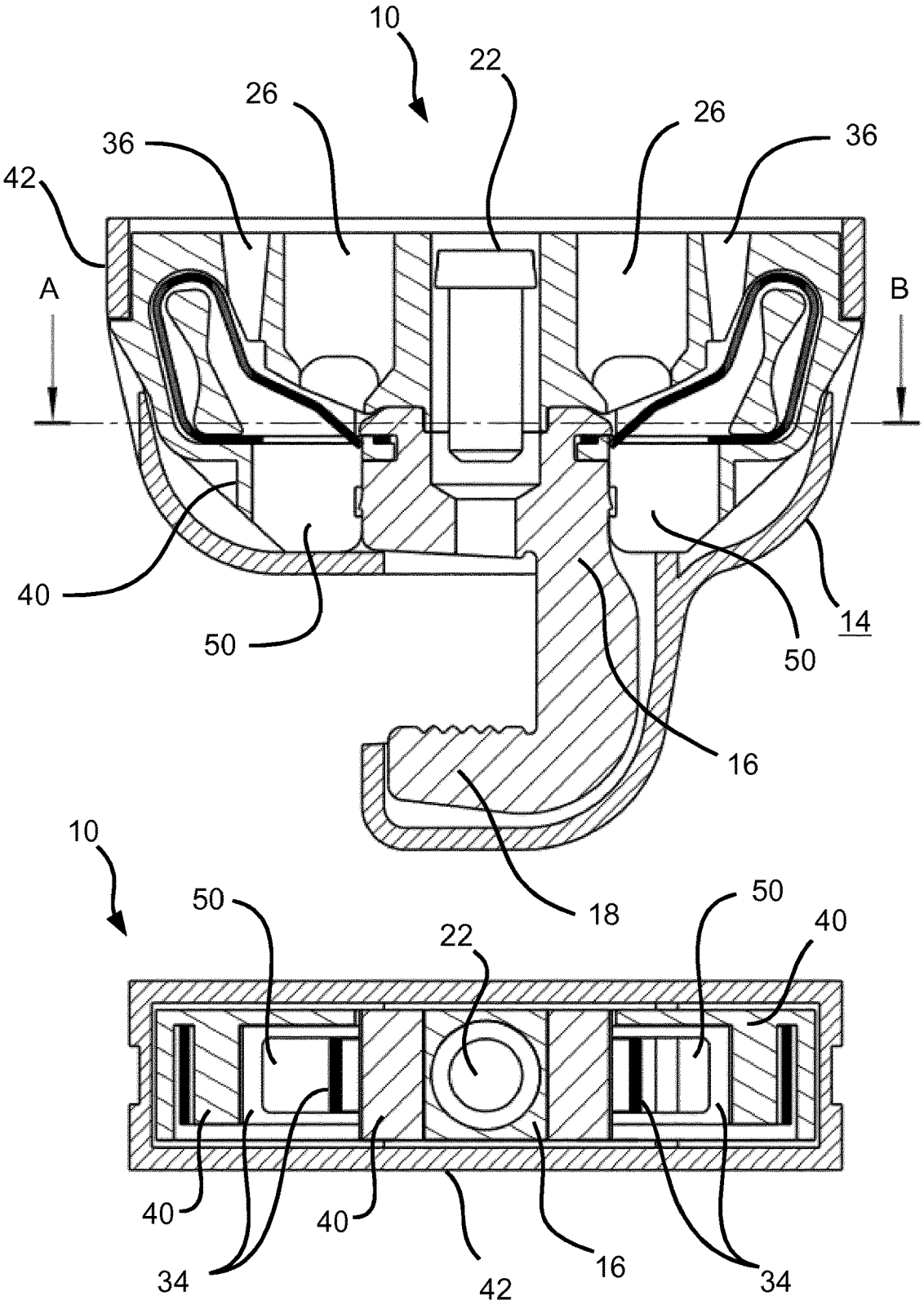
FIG. 9 shows the busbar tapping clamp according to FIG. 3 in the longitudinal section as in FIGS. 7*a*, 7*b*, and in a further section along a section plane perpendicular to the section plane used in FIGS. 7*a*, 7*b*.

The illustration in FIG. 9 shows on the one hand the busbar tapping clamp 10 in an illustration as in FIG. 7, and on the other hand, a sectional illustration along the section line denoted by reference character AB. The section along the section line AB extends just above the leg, which is horizontal in the illustration, of the spring force clamps 34. In the sectional illustration, the view of this leg of the spring force clamps 34 and the eyelet therein, as well as the adjoining connection space 50 beneath same, is unobstructed. The cross section of the movable leg of the spring force clamps 34 is also apparent.

Figure 10:
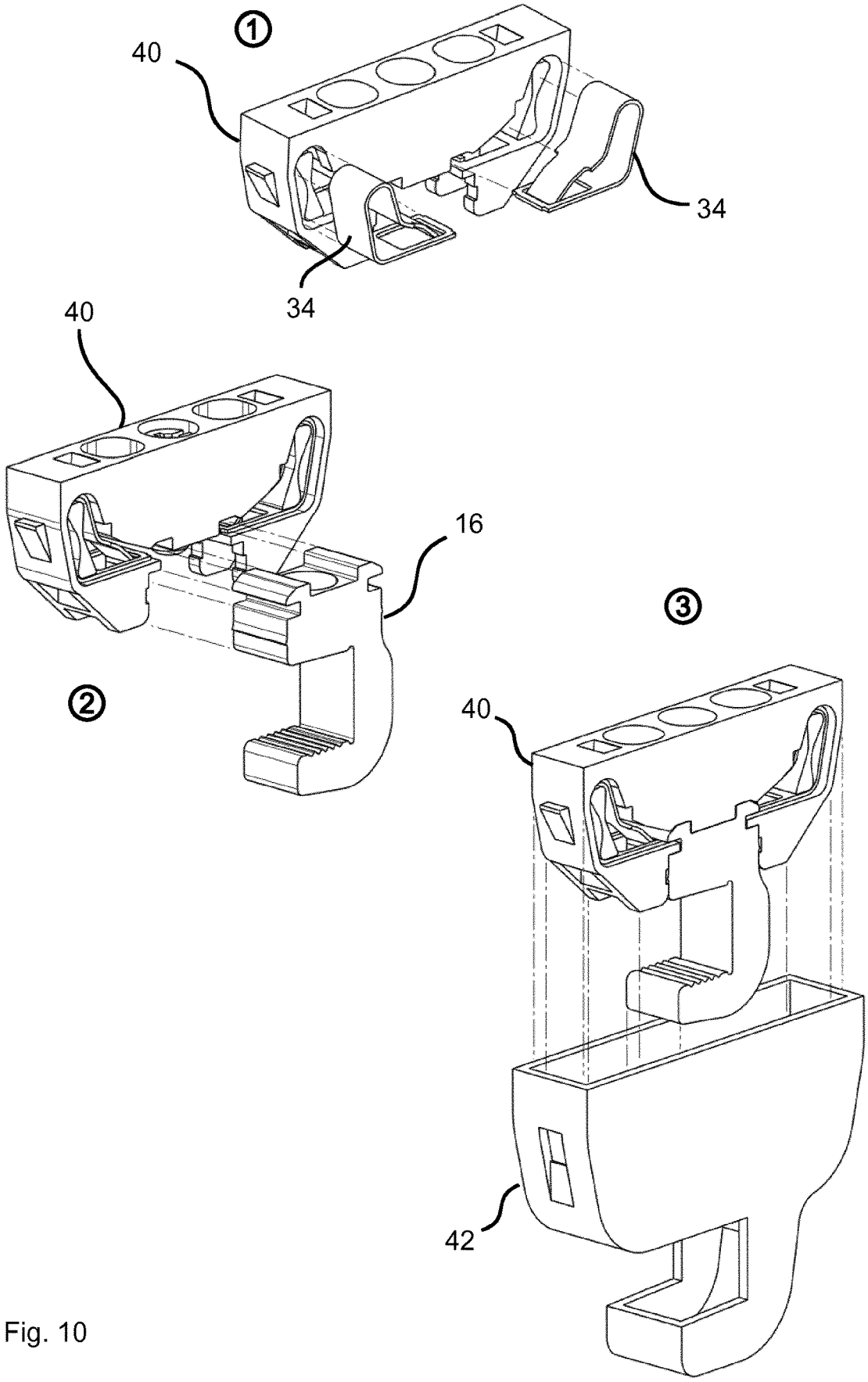
FIG. 10 shows "snapshots" during manufacture of the busbar tapping clamp according to FIG. 3.

The illustration in FIG. 10 shows "snapshots" during manufacture/installation of a busbar tapping clamp 10 in a schematically simplified manner. It is shown that in a first step, the spring force clamps 34 are initially placed in the inner housing part 40, namely, in each case in a clamp spring seat contour provided for this purpose. The clamping member 16 is placed in the inner housing part 40 in a subsequent second step. The tabs 44 of the inner housing part 40 and the recesses 46 in the clamping member, or in general, the particular clamping member retaining means 44, 46, thus engage with one another. This results in a part having three different components, namely, the inner housing part 40, the clamping member 16, and the spring force clamps 34. The sequence of steps 1 and 2 may also be interchanged for manufacture of the part. This part 40, 16, 34 as a whole is combined with the outer housing part 42, and for this purpose is pushed into the outer housing part 42. The inner housing part 40 may thus be connected to the outer housing part 42 in a locking manner. The manufacture/installation of the busbar tapping clamp 10 is thus concluded, without tools.

Individual primary aspects of the description submitted herein may be briefly summarized as follows: A busbar tapping clamp 10 according to DE 20 2011 000 622 U1 or DE 10 2012 203 554 A is provided, comprising a clamping member 16 that is fixable to a busbar 12 in the manner of a screw clamp, or optionally according to DE 20 2011 000 622 U1 or DE 10 2012 203 554 A, comprising means 34 for bringing a conductor 32, led to the busbar tapping clip 10, into electroconductive contact with the clamping member 16, using clamping spring technology, i.e., a busbar tapping clamp 10 using clamping spring technology.

LIST OF REFERENCE NUMERALS

10 busbar tapping clamp
12 busbar
14 housing
16 clamping member
18 (hook-shaped) extension (on the clamping member)
20 clamping screw thread hole
22 clamping screw
24 connection side
26 conductor insertion opening
28 top side
30 recess (enclosed by the clamping member and its extension)
32 conductor
34 actuating element/spring force clamp
36 tool insertion opening
38 tool
40 inner housing part
42 outer housing part
44 clamping member retaining means/tab
46 clamping member retaining means/recess
48 supporting surface
50 connection space
52 contact surface (of the clamping member)

The invention claimed is:

1. A busbar tapping clamp (10) comprising:

a housing, a busbar clamping member (16) that is situated in the housing (14), comprising a hook-shaped extension (18) within the housing, which is a part of a clamping device (18, 22) which electroconductively contacts a busbar (12), and which mechanically fixes the busbar tapping clamp (10) to the busbar (12) using the extension (18) of the busbar clamping member (16) as a stop, a conductor contacting spring member (34) within the housing (14) for electroconductively contacting a conductor (32) inserted into the housing (14), into electroconductive contact with the busbar clamping member (16), using clamping spring technology, and wherein the housing (14) is an at least two-part housing (14) comprising an inner housing part (40) and an outer housing part (42) that accommodates the inner housing part (40), wherein the housing (14) and the busbar clamping member (16) comprise a clamping member retaining structure (44, 46) defined between the inner housing part (40) and the busbar clamping member (16) to engage the inner housing part (40), the conductor contacting spring member (34) and the busbar clamping member (16) so to define a relative position of the housing (14), the busbar clamping member (16), and the, or each, conductor contacting spring member (34) for electroconductively contacting a conductor (32).

2. The busbar tapping clamp (10) according to claim 1 wherein the clamping member retaining structure (44, 46) comprises recesses (46) in the busbar clamping member (16) as well as tabs (44) on the housing (14) intended for engaging in these recesses (46).

3. The busbar tapping clamp (10) according to claim 2, wherein the conductor contacting spring member (34) comprises spring force clamps (34) having a fixed leg and a movable leg for electroconductively contacting a conductor (32), and wherein a free end of each fixed leg engages in the recess (46) in the busbar clamping member (16).

4. The busbar tapping clamp (10) according to claim 1, wherein the busbar clamping member (16) for electroconductively contacting a conductor (32) includes lateral contact surfaces (52), and on each of these surfaces has at least one notch.

5. The busbar tapping clamp (10) according to claim 1, wherein the busbar clamping member (16) is a solid, one-piece component having at least one clamping screw thread hole (20), wherein the clamping device includes at least one clamping screw (22) that is guided in the clamping screw thread hole (20), and wherein by means of the clamping screw (22) the busbar tapping clamp (10) is fixable to the busbar (12) by clamping the busbar (12) via the clamping screw (22), and to a portion of the extension (18) that functions as the stop.

6. A method for manufacturing a busbar tapping clamp (10) according to claim 1, wherein the conductor contacting spring member (34) comprises spring force clamps (34) disposed in the inner housing part (40) in recesses for electroconductively contacting a conductor (32) inserted into the housing (14), wherein the busbar clamping member (16), with engagement of the clamping member retaining structure (44, 46) with one another, is placed in the inner housing part (40), and wherein the inner housing part (40) together with the spring force clamps (34) mounted in/on same and the busbar clamping member (16) are inserted into the outer housing part (42).

7. A method for manufacturing a busbar tapping clamp (10) according to claim 2, wherein the conductor contacting spring member (34) comprises spring force clamps (34) disposed in the inner housing part (40) in recesses for electroconductively contacting a conductor (32) inserted into the housing (14), wherein the busbar clamping member (16), with engagement of the clamping member retaining structure (44, 46) with one another, is placed in the inner housing part (40), and wherein the inner housing part (40) together with the spring force clamps (34) mounted in/on same and the busbar clamping member (16) are inserted into the outer housing part (42).

8. The busbar tapping clamp (10) according to claim 2, wherein the busbar clamping member (16) for electroconductively contacting a conductor (32) includes lateral contact surfaces (52), and on each of these surfaces has at least one notch.

9. The busbar tapping clamp (10) according to claim 2, wherein the busbar clamping member (16) is a solid, one-piece component having at least one clamping screw thread hole (20), wherein the clamping device includes at least one clamping screw (22) that is guided in the clamping screw thread hole (20), and wherein by means of the clamping screw (22) the busbar tapping clamp (10) is fixable to the busbar (12) by clamping the busbar (12) via the clamping screw (22), and to a portion of the extension (18) that functions as the stop.

10. A method for manufacturing a busbar tapping clamp (10) according to claim 3, wherein the conductor contacting spring member (34) comprises spring force clamps (34) disposed in the inner housing part (40) in recesses for electroconductively contacting a conductor (32) inserted into the housing (14), wherein the busbar clamping member (16), with engagement of the clamping member retaining structure (44, 46) with one another, is placed in the inner housing part (40), and wherein the inner housing part (40) together with the spring force clamps (34) mounted in/on same and the busbar clamping member (16) are inserted into the outer housing part (42).

11. The busbar tapping clamp (10) according to claim 3, wherein the busbar clamping member (16) for electroconductively contacting a conductor (32) includes lateral contact surfaces (52), and on each of these surfaces has at least one notch.

12. The busbar tapping clamp (10) according to claim 3, wherein the busbar clamping member (16) is a solid, one-piece component having at least one clamping screw thread hole (20), wherein the clamping device includes at least one clamping screw (22) that is guided in the clamping screw thread hole (20), and wherein by means of the clamping screw (22) the busbar tapping clamp (10) is fixable to the busbar (12) by clamping the busbar (12) via the clamping screw (22), and to a portion of the extension (18) that functions as the stop.

13. A method for manufacturing a busbar tapping clamp (10) according to claim 4, wherein the conductor contacting spring member (34) comprises spring force clamps (34) disposed in the inner housing part (40) in recesses for electroconductively contacting a conductor (32) inserted into the housing (14), wherein the busbar clamping member (16), with engagement of the clamping member retaining structure (44, 46) with one another, is placed in the inner housing part (40), and wherein the inner housing part (40) together with the spring force clamps (34) mounted in/on same and the busbar clamping member (16) are inserted into the outer housing part (42).

14. A method for manufacturing a busbar tapping clamp (10) according to claim 5, wherein the conductor contacting spring member (34) comprises spring force clamps (34) disposed in the inner housing part (40) in recesses (311) for electroconductively contacting a conductor (32) inserted into the housing (14), wherein the busbar clamping member (16), with engagement of the clamping member retaining structure (44, 46) with one another, is placed in the inner housing part (40), and wherein the inner housing part (40) together with the spring force clamps (34) mounted in/on same and the busbar clamping member (16) are inserted into the outer housing part (42).

* * * * *